US006234715B1

(12) United States Patent
Ono

(10) Patent No.: US 6,234,715 B1
(45) Date of Patent: May 22, 2001

(54) UNDERWATER TRUSS STRUCTURE

(76) Inventor: Taisaburo Ono, 351-1 Ninomiya, Ninomiya-machi, Naka-gun, Kanagawa-ken (JP)

( * ) Notice: Subject to any disclaimer, the term of this patent is extended or adjusted under 35 U.S.C. 154(b) by 0 days.

(21) Appl. No.: 09/270,709

(22) Filed: Mar. 16, 1999

(30) Foreign Application Priority Data

Aug. 12, 1998 (JP) ..... 10-227742

(51) Int. Cl.[7] ..... E02B 3/06
(52) U.S. Cl. ..... 405/29; 405/21
(58) Field of Search ..... 405/29, 15, 27, 405/28, 21

(56) References Cited

U.S. PATENT DOCUMENTS 1,516,767 * 11/1924 Falley ..... 405/28
2,658,350 * 11/1953 Magill ..... 405/27
3,884,042 * 5/1975 Anderson et al. ..... 405/27
4,175,887 * 11/1979 Mougin ..... 405/28 X
4,439,058 * 3/1984 Le Mehaute ..... 405/28 X
5,427,472 6/1995 Ono .

FOREIGN PATENT DOCUMENTS 64-247413 10/1988 (JP) .
0844659 * 7/1981 (SU) ..... 405/29

* cited by examiner

*Primary Examiner*—Eileen D. Lillis
*Assistant Examiner*—Frederick L. Lagman
(74) *Attorney, Agent, or Firm*—Nixon Peabody LLP; Donald R. Studebaker

(57) ABSTRACT

In an underwater truss structure including a large number of mutually nonparallel rods 11 provided with brims 32', the shape of the brims 32' is made a polygonal shape that enables gaps 33, 34 between adjacent brims to be adjusted between touching and a desired size. This enables shield factor to be markedly improved to effectively achieve diverse interference control and to be made freely adjustable.

12 Claims, 2 Drawing Sheets

— PRIOR ART —

UNDERWATER TRUSS STRUCTURE

BACKGROUND OF THE INVENTION

1. Field of the Invention

This invention relates to an improved underwater truss structure, and more particularly to an improved underwater truss structure wherein rods of an underwater truss including a large number of mutually nonparallel rods are provided with plate-like structural members (hereinafter "brims") having surfaces orthogonal to the rods.

2. Description of the Related Art

The present inventor earlier invented a fluid-interference structure utilizing an underwater truss that can be used as a marine structure in place of conventional concrete-caisson breakwaters, tetrapods and other such structures that rely on weight. This is a light-weight marine structure composed of units of uniform, easy-to-handle size. It can be mass-produced as a standardized product at low cost and is usable even on ground that is too weak for use of a conventional structure. The basic structure is described in Japanese Patent Publication No. 58(1983)-26443 and various improved structures are disclosed in, for example, Japanese Unexamined Patent Publication No. 63(1988)-247413, Japanese Unexamined Utility Model Publication No. 1(1989)-180530, Japanese Unexamined Patent Publication No. 2(1990)-70812, Japanese Unexamined Patent Publication No. 6(1994)-136727, Japanese Unexamined Patent Publication No. 6(1994)-264423, Japanese Unexamined Patent Publication No. 6(1994)-280234 and Japanese Unexamined Patent Publication No. 8(1996)-105030.

The basic structural unit of the underwater truss structure consists of a planar skeleton composed of rods and spheres assembled in planar interconnection and a three-dimensional skeleton of an interconnected regular triangular pyramid and a regular square pyramid. One of the disclosed structures is provided with plate-like brims having surfaces orthogonal to the rods. Basically, this underwater truss structure operates by utilizing the interference between a fluid passing through the interior of the structure and the shape of the structure to agitate the motion of the fluid and convert it into a turbulent flow. Providing disk-like brims on the rods markedly increases the contact area with the fluid per unit volume. Since this increases the capability of the structure to interfere with fluid motion, the underwater truss structure with brims is immensely more cost-effective than conventional marine structures.

The underwater truss structure with brims can provide a considerable interference effect in the case of a wave component having high kinetic energy per spatial unit. Still, irrespective of this and its ability simply to interfere with a large wave to give it a desired waveform, it cannot totally eradicate waveforms and therefore cannot perform sufficiently as a practical breakwater structure.

The underwater truss structure with brims can, however, be effectively utilized for systematically converting waves, tides, currents and other types of fluid motion into turbulent flow and eddies and/or into the microdisturbed state. Owing to its relatively light weight, moreover, the structure has the potential for practical application at low cost from the viewpoint of production, assembly and installation. Taking actual needs in coastal waters into account, therefore, it is desirable to pursue its further development toward enabling use of the sea's kinetic energy in diverse ways.

Specifically, the kinetic energy of ocean waves is potentially utilizable for various purposes, such as to improve water quality by increasing dissolved oxygen and to enhance the amount of deep-region nutrient salts conducted to and mixed with water in the photic region for instance, in order to create an environment for adherence of useful plant life. The structure should therefore desirably be improved to have control capabilities enabling such uses of wave energy in costal waters.

SUMMARY OF THE INVENTION

This invention was accomplished in light of the foregoing circumstances and has as one object to provide an underwater truss structure with brims that effectively achieves diverse interference control and further enables free control of shield factor.

The underwater truss structure according to the invention is an underwater truss structure including a large number of mutually nonparallel rods provided with plate-like brims having surfaces orthogonal to the rods, characterized in that the brims have a polygonal shape enabling gaps formed between adjacent brims to be adjusted between touching and a desired size. The shape of the brims determines the functions that the different portions of the underwater truss structure can provide.

As explained in the following, the term "gaps formed between adjacent brims" is defined broadly to encompass various types of gaps formed between adjacent brims.

When brims are provided at a fixed location on every rod, the brim surfaces can be expanded to bring their edge portions into contact along straight. lines. In this case, the brim has maximum area and is square in shape. When the brim surfaces are interconnected and expanded, the interconnected brims define a space and shielding is possible. When the areas of the brims that contact in this way when the area is maximum are mutually contracted, gaps can be formed between the brims, and the gaps enlarge as the brims contract. The method of contracting the brim area is not limited to overall contraction while maintaining similarity but also includes cutting off corners of the squares to form polygons. The shield factor of the truss structure can be freely adjusted by increasing/decreasing the area of the brims.

For example, by using twelve sphere-like connecting members formed as dodecahedrons each provided with twelve rod-fixing holes to connect a large number of rods, the brims can be made square, hexagonal or octagonal. The shield factor can then be freely adjusted by varying the size of the brims.

As shown in JP-A-8-105030, openings can be formed in the brim surfaces by trimming the edges of the brims into an irregular shape. Such openings enhance the fineness of the induced eddies.

Adjacent brims are preferably fastened together. In practice there is used a method of elastic fastening or connection that can be easily undone.

Since the underwater truss structure according to the invention adopts polygonal brims that enable the gaps between adjacent brims to be systematically adjusted to desired sizes, the underwater truss structure has enhanced performance and enables free selection of shield factor.

In actual application, the underwater truss structure can, for example, be assembled into a large-scale structure enclosing a particular region of the sea so as to enrich the biosystem within the enclosed region and thereby enable systematic enhancement of productivity. This effect can be obtained because the adjacent brims, owing to their shapes and the gaps therebetween, convert the energy of sea wave motion to produce an intermixed region of large and small eddies. Moreover, by appropriate installation of underwater truss structures with brims provided with openings by irregular trimming of edge portions as taught by JP-A-8-105030, white clouding can be forcibly induced by fine-foaming to establish an enhanced aeration effect that raises the level of dissolved oxygen to a supersaturated state, thereby achieving water quality improvement and other effects. This boosts the basic productive capacity by photosynthesis within the enclosed region and, as such, enriches the biosystem. A particular objective is to preserve kinetic energy in vortices so that water masses can be mass-transported during the process of force synthesis.

Interconnection of adjacent brims increases the strength of the overall structure and enables fabrication of a stable underwater truss structure.

DESCRIPTION OF THE PREFERRED EMBODIMENTS

Embodiments of the underwater truss structure according to the invention will now be explained with reference to the attached drawings.

Figure 1:
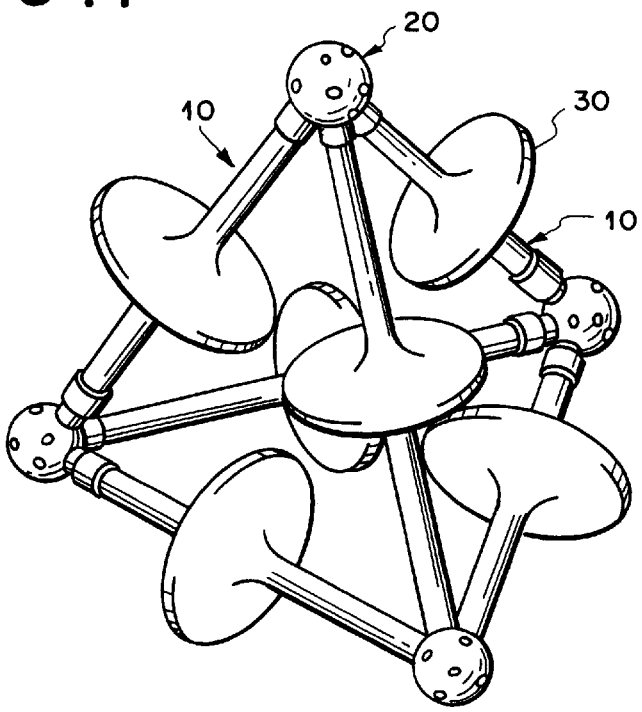
FIG. 1 is a perspective view showing an example of a conventional underwater truss structure.

FIG. 1 is a perspective view showing an example of a conventional underwater truss structure with circular brims. This is one of the basic conventional underwater truss structures. This underwater truss structure is composed of six rods 10 each having a circular brim 30 fixed at its middle in the axial direction and four spheres 20. These members are assembled into a regular triangular pyramid having the spheres 20 at its apices. Although the brims 30 are rigidly fixed to the rods 10 in the configuration of FIG. 1, they can instead be elastically attached thereto. Moreover, the number of brims 30 attached to the rods 10 is not limited to that shown but can be increased. Elastic attachment of the brims 30 to the rods 10 is described in detail in JU-A-1-180530.

The shield factor of the underwater truss structure configured in the foregoing manner can be markedly increased by changing the shape of the brims 30 to polygonal. An example of this will now be explained.

Figure 2:
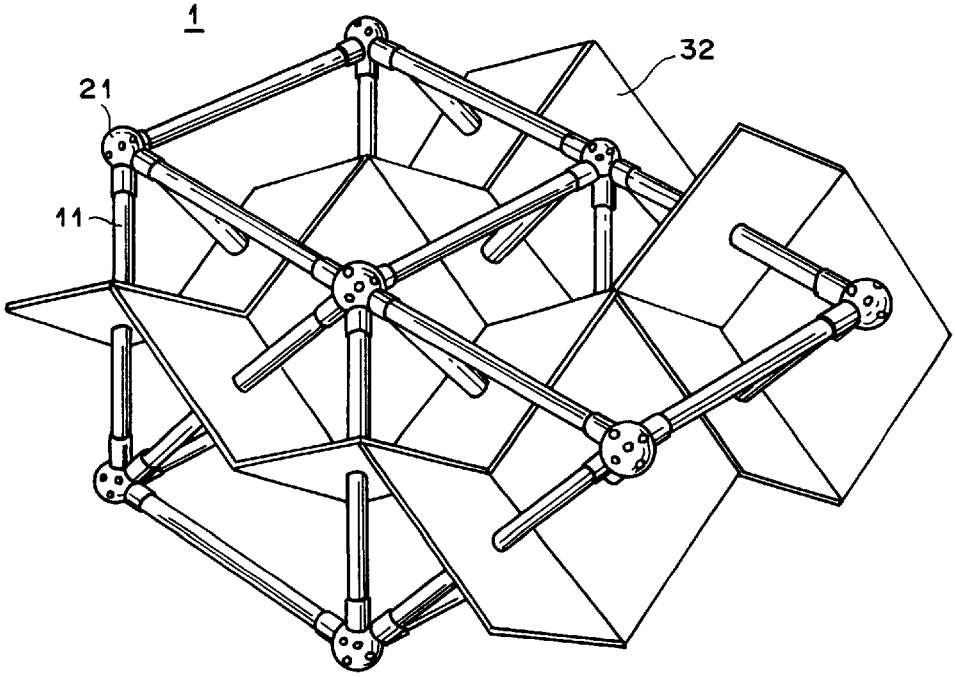
FIG. 2 is a perspective view showing a portion of an underwater truss structure with rectangular brims that is a first embodiment of the invention.

FIG. 2 is a perspective view showing a portion of an underwater truss structure adopting square brims according to the invention. This underwater truss structure 1 is composed by connecting a large number of regular square pyramid skeletons each formed of eight rods 11 interconnected and regular tetrahedrons each formed of six rods 11 including three rods 11 forming a side surface of a regular square pyramid. FIG. 2 shows one portion thereof. Square brims 32 are provided at the middles of the rods 11. The rods 11 are interconnected by spheres 21 each formed with twelve rod-fixing holes and having the basic structure of a dodecahedron.

In the illustrated embodiment, the shape of the brims 32 is square, adjacent brims 32 contact, and the theoretical shield factor is 100%.

Figure 3:
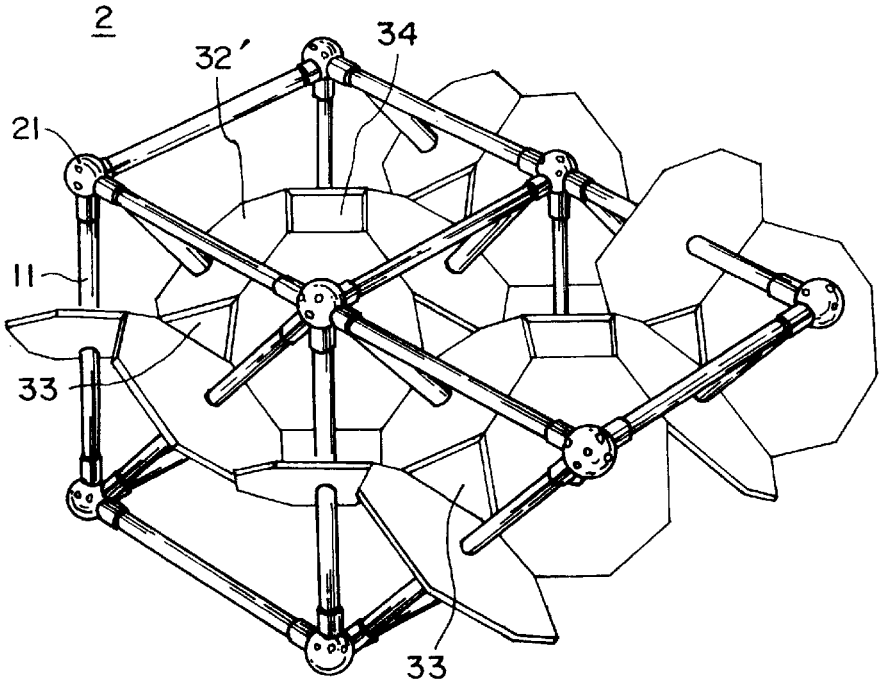
FIG. 3 is a perspective view showing a portion of an underwater truss structure with octagonal brims that is a second embodiment of the invention.

In the structure configured in this manner, by cutting off the corners of the square brim 32 to form octagonal brims 32' as shown in FIG. 3, there can be formed triangular or square openings 33, 34 at portions where the corners of three or four brims 32' meet. The shield factor of the structure 2 can be adjusted by varying the size thereof. The edge portions of mutually contacting adjacent brims make elastic contact.

Although not illustrated, the sides of the square brims 32 shown in FIG. 2 can be drawn back to form gaps between the facing parallel sides of adjacent pairs of brims. The shield factor of the structure can be adjusted by varying the size of the gaps. In this case, the proximate edge portions of adjacent brims can be elastically connected by a connecting members.

Alternatively, different types of gaps can be appropriately intermixed and adjusted.

Figure 4:
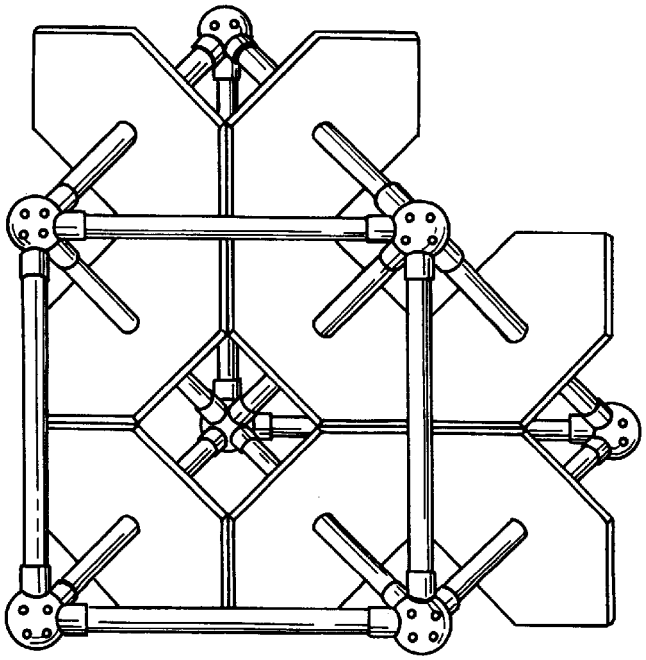
FIG. 4 is a perspective view showing a portion of an underwater truss structure with hexagonal brims that is a third embodiment of the invention.

FIG. 4 is a perspective view showing an embodiment wherein only two diagonally opposite corners of the square brims shown in FIG. 2 are cut off to form hexagonal brims and provide square openings.

What is claimed is:

1. An underwater truss structure, comprising:

a plurality of connected rods forming a basic pyramidal truss structure, each of the rods comprises two ends and a polygonal-shaped brim disposed between the two ends, wherein each polygonal-shaped brim comprises surfaces orthogonal to the rod so as to increase surface area in contact with fluids passing through the underwater truss structure and thereby provide a wave damping effect.

2. The underwater truss structure according to claim 1, further comprising:

a plurality of spherical connecting members for connecting the plurality of rods at their ends to form the basic pyramidal structure.

3. The underwater truss structure according to claim 2, wherein the spherical connecting members are dodecahedron, and the polygonal-shaped brims comprise a square, hexagon, or octagon.

4. The underwater truss structure according to claim 3, wherein each polygonal-shaped brim comprises edge portions that are in contact with adjacent brims.

5. The underwater truss structure according to claim 4 herein the polygonal-shaped brims that are adjacent and in contact with one another are fastened together so as to increase the strength of the truss structure.

6. The underwater truss structure according to claim 2, wherein the polygonal-shaped brims comprise edges of irregular shapes.

7. The underwater truss structure according to claim 2, wherein the basic pyramidal structure is a triangular pyramidal structure comprising six interconnected rods.

8. The underwater truss structure according to claim 2, wherein the basic pyramidal structure is a square pyramidal structure comprising of eight interconnected rods.

9. The underwater truss structure according to claim 1, wherein the polygonal-shaped brims are of a predetermined shape so as to provide a desirable shield factor.

10. The underwater truss structure according to claim 1, wherein the polygonal-shaped brims are adjacent to one another in the basic structure, and the polygonal-shaped brims are of result-effective size so as to form gaps therebetween.

11. The underwater truss structure according to claim 1, wherein the polygonal-shaped brims are of a predetermined size so as to provides a desirable shield factor.

12. The underwater truss structure according to claim 1, wherein the polygonal-shaped brims comprise edges of irregular shapes.

* * * * *